US009770737B1

(12) United States Patent
Polhert et al.

(10) Patent No.: US 9,770,737 B1
(45) Date of Patent: Sep. 26, 2017

(54) CUSTOM PAINT TOUCH UP TOOL

(71) Applicants: Christopher Allen Polhert, Lake of the Woods, CA (US); Cristi Marie Polhert, Lake of the Woods, CA (US)

(72) Inventors: Christopher Allen Polhert, Lake of the Woods, CA (US); Cristi Marie Polhert, Lake of the Woods, CA (US)

( * ) Notice: Subject to any disclaimer, the term of this patent is extended or adjusted under 35 U.S.C. 154(b) by 198 days.

(21) Appl. No.: 14/611,078

(22) Filed: Jan. 30, 2015

Related U.S. Application Data

(60) Provisional application No. 61/934,494, filed on Jan. 31, 2014.

(51) Int. Cl.
*B05C 17/10* (2006.01)
*B65D 51/32* (2006.01)
*B65D 83/00* (2006.01)

(52) U.S. Cl.
CPC ..... *B05C 17/10* (2013.01); *B65D 51/32* (2013.01); *B65D 83/0033* (2013.01)

(58) Field of Classification Search
CPC combination set(s) only.
See application file for complete search history.

(56) References Cited

U.S. PATENT DOCUMENTS

| | | | | |
|---|---|---|---|---|
| 919,466 | A * | 4/1909 | Ripley | B43K 5/06 401/182 |
| 2,138,696 | A * | 11/1938 | Francis | B05C 17/01 401/176 |
| 6,200,054 | B1 * | 3/2001 | Chen | E04G 23/0203 222/386 |
| 6,254,299 | B1 | 7/2001 | Russo | |
| 6,749,356 | B1 * | 6/2004 | Mead | B05C 17/0136 401/176 |
| 7,182,538 | B2 | 2/2007 | Grosso | |
| 7,338,225 | B1 | 3/2008 | Taylor | |
| 8,092,108 | B2 * | 1/2012 | Bainbridge | B05C 17/00516 401/171 |

* cited by examiner

*Primary Examiner* — David Walczak
(74) *Attorney, Agent, or Firm* — Thomas I. Rozsa

(57) ABSTRACT

A one-step process to store paint for use in touching up painted walls. The invention tool removes the need to break out all the paint supplies to fix a small scratch or nick in the wall. The invention tool is a custom paint storage container and applicator. When a user is painting the user's walls, the user can fill up the custom tool of the present invention with the same paint and store the small leak proof bottle of the tool almost anywhere. Then, if a wall becomes scratched or nicked or if objects that have been hung on the wall need to be removed or relocated, the tool can be used to have the applicator apply paint from the original paint source to touch up the nick or scratch or hole.

15 Claims, 10 Drawing Sheets

CUSTOM PAINT TOUCH UP TOOL

CROSS-REFERENCE TO RELATED APPLICATION

This patent application claims priority to Provisional Application No. 61/934,494 filed on Jan. 31, 2014.

BACKGROUND OF THE INVENTION

1. Field of the Invention

The present invention relates in general to the field of painting any painted surface. The present invention relates to the field of providing touch up paint so that an unsightly hole or other blemish in a surface painted with original paint can be repaired by touch up paint which comes from the same paint as originally used to paint the surface.

2. Description of the Prior Art

In general, the concept of having touch up paint applicators has been known. However, the prior art known to the present inventors are bulky and difficult to use. The prior art of which the present inventors are aware are as follows:

1. U.S. Pat. No. 6,254,299 issued to Russo on Jul. 3, 2001 for "Paint Applicator System". This device involves a paint applicator using a paint reservoir which is connected to a slidable nib which permits paint to pass through the reservoir to the exterior of the nib. The paint composition is placed in the reservoir and is predetermined to posses a viscosity of between 25 and 115 centipoise by the use of selective solvents.

2. U.S. Pat. No. 7,182,538 issued to Grosso on Feb. 27, 2007 for "Paint Dispensing and Storage Kit". This invention requires a paint cartridge to dispense paint.

3. U.S. Pat. No. 7,338,225 issued to Taylor on Mar. 4, 2008 for "Touch Up Paint Applicator". This discloses a refillable pen which has a sponge tip and dispenses paint onto a substrate to repair a blemished paint surface when the sponge tip is pressed against the substrate.

There is a significant need for a simple device which can store paint from an original paint can used to paint the wall so that a small touch up amount of the same paint is available to touch up holes and other nicks in the painted surface and also to touch up holes which may be left by apparatus such as a nail or picture hanger which leaves a hole when it is removed and there is redecoration of the walls of the room.

SUMMARY OF THE INVENTION

The present invention is a one-step process to store paint for use in touching up painted surfaces. The present invention removes the need to break out all the painting supplies to fix a small scratch or nick in the painted surface or to cover a small area of a hole in a wall which has been patched after removal of a nail, picture hanger or similar object which required hammering an object into the wall and which created a hole in the wall which required patching and paint matching the paint on the remaining section of the wall or surface.

The present invention is a custom paint storage container and applicator. When the user is painting the user's walls, they can fill up the custom container of the present invention with the same paint and store the small leak proof container almost anywhere. Then, if the painted surface becomes scratched or nicked or if objects that have been hung on the wall need to be removed or relocated, the present invention can be used to touch up the damaged area.

It is an object of the present invention to provide an apparatus to store paint from an original paint can used to paint any painted surface such as a wall, automobile, boat or furniture.

It is a further object of the present invention to store a sample specimen of the original paint used to paint a wall or other interior surface of a structure with a mechanism so that the paint can be stored for an indefinite period of time and a mechanism to mix up the paint within the container so that the paint is fresh and ready for immediate application in a simple process.

It is a further object of the present invention to provide a syringe type mechanism which enables paint from an original paint can to be sucked in or drawn into the syringe mechanism so that a full volume of the syringe contains the required paint. The syringe also contains a mixing apparatus such as a small ball bearing which can mix up paint that has been stored for a period of time so that the paint is fluid and ready for application. The syringe contains a removable cap which contains an applicator on the cap. The cap can be affixed to a nozzle of the syringe which can be either a press fit or can have other affixation means such as partial male threads on the nozzle of the syringe and mating female threads on a portion of the cap.

Described generally, the present invention is a paint touch up tool comprising: (a) a syringe which houses an enclosed interior chamber which is surrounded by a circumferential wall; (b) a movable plunger movably retained at a rear end of the interior chamber, the movable plunger surrounded by a first mating exterior wall, a sealing member adjacent a proximal end of the plunger located at the base of the exterior wall and retained adjacent the base of the exterior wall of the syringe after the plunger is removed, the movable plunger also having a rear handle with a multiplicity of shafts between the first mating exterior wall and the handle; (c) a front end of the interior chamber leading to a nozzle which is closed by a closing applicator cap; (d) a paint mixer retained in the enclosed interior chamber; (e) an extender when not in use is retained separately from the plunger or alternatively may be retained between the first mating interior wall and the rear handle;

(f) when the closing applicator cap is removed from the nozzle, the extender is placed over the nozzle and the plunger is used to suck paint out of a paint retaining member such as a paint can and into the body of the syringe; (g) The extender is removed, the sealed cap is replaced onto the nozzle to seal the syringe with the paint therein and the rear handle is removed to enable the paint filled apparatus to be stored until needed.

The present invention can also be described as a method of storing paint for future touch up of small areas of a painted surface and utilizing a paint touch up tool comprising: (a) a syringe which houses an enclosed interior chamber which is surrounded by a circumferential wall; (b) a movable plunger movably retained at a rear end of the interior chamber, a sealing member adjacent a proximal end of the plunger located at the base of the exterior wall and retained adjacent the base of the exterior wall of the syringe afer the plunger is removed, the movable plunger also having a rear handle with a multiplicity of shafts between the first mating exterior wall and the handle; (c) a front end of the interior the movable plunger surrounded by a first mating exterior wall, the movable plunger also having a rear handle with a multiplicity of shafts between the first mating exterior wall and the handle; (c) a front end of the interior chamber leading to a nozzle which is closed by a closing applicator cap; (d) a paint mixer retained in the enclosed interior chamber; (e) an extender when not in use is retained separately from the applicator tool or optionally retained between the first mating interior wall and the rear handle; (f) when the closing applicator cap is removed from the nozzle, the extender is placed over the nozzle; and (g) pushing the movable plunger to adjacent the nozzle within the interior chamber, placing the applicator on the nozzle after the closing applicator cap has been removed and drawing paint out of the paint can through suction by withdrawing the nozzle until it reaches the rear end of the interior chamber, removing the extender and replacing the cap onto the nozzle to close the nozzle so that the paint is contained in a closed condition, and thereafter removing the handle.

Overall, it is a main object of the present invention to provide a simple and efficient apparatus to store paint from an original paint or original paint retaining container can so that nicks, scratches and holes or other blemishes in painted surfaces can be easily and quickly patched and painted with the original paint so that the touch up is not noticeable.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF EMBODIMENTS OF THE PRESENT INVENTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
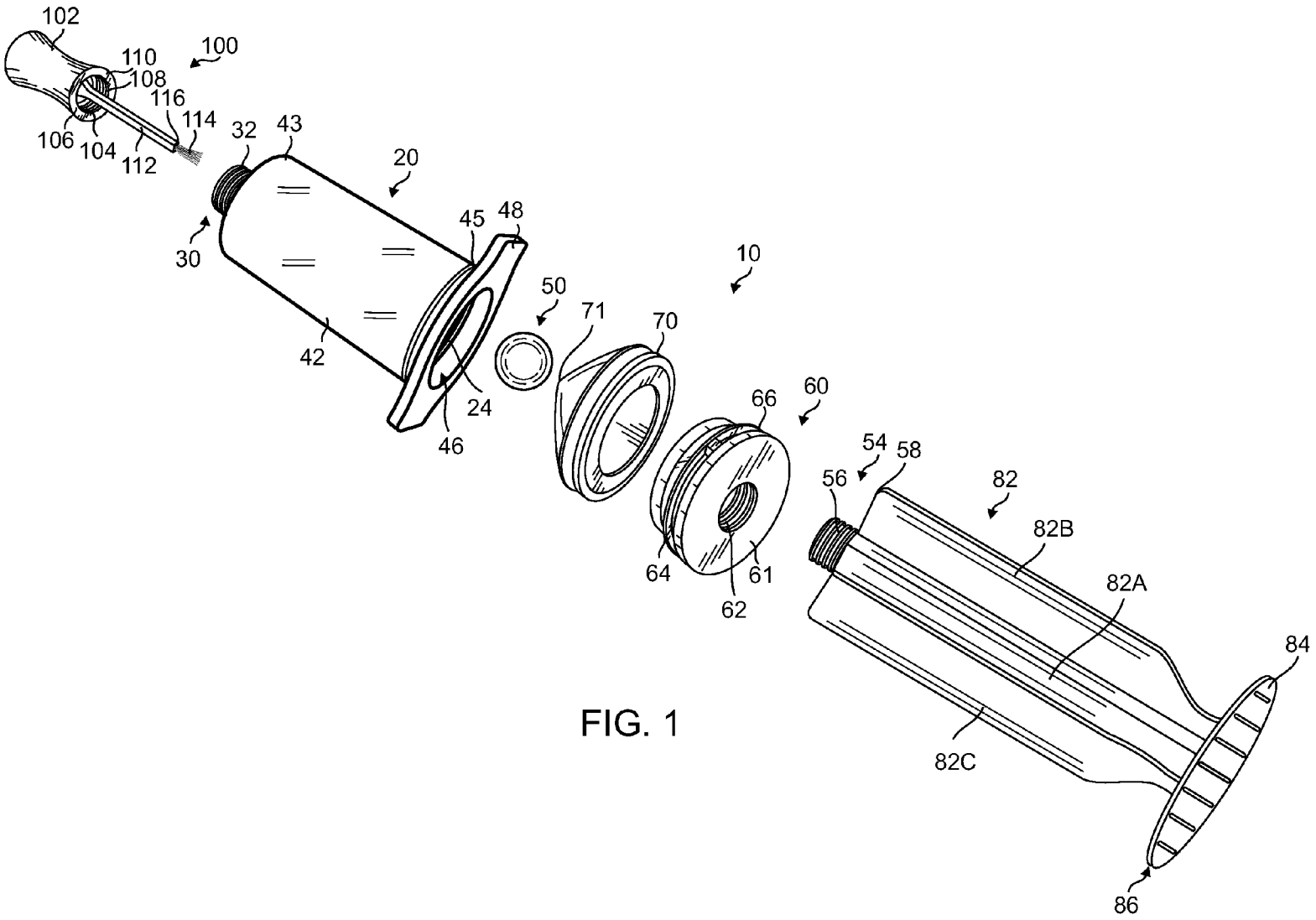
FIG. 1 is a perspective exploded view of an embodiment of the present invention paint touch up tool, including one embodiment of a sealing cap having internal threads and an internally retained shaft with an applicator brush extending out of a distal end of the sealing cap, a retaining body having a threaded exterior nozzle at a proximal end leading to an interior chamber surrounded by an exterior wall terminating at a distal end with a base, a paint mixer such as a ball bearing, a plunger having a threaded shaft at its proximal end threaded onto interior threads on a base wall of a sealing disc incorporated into a plunger tip, a flexible seal retained in a circumferential groove of the sealing disc and the plunger having a handle including a multiplicity of shafts terminating in a base at its distal end.
Figure 2:
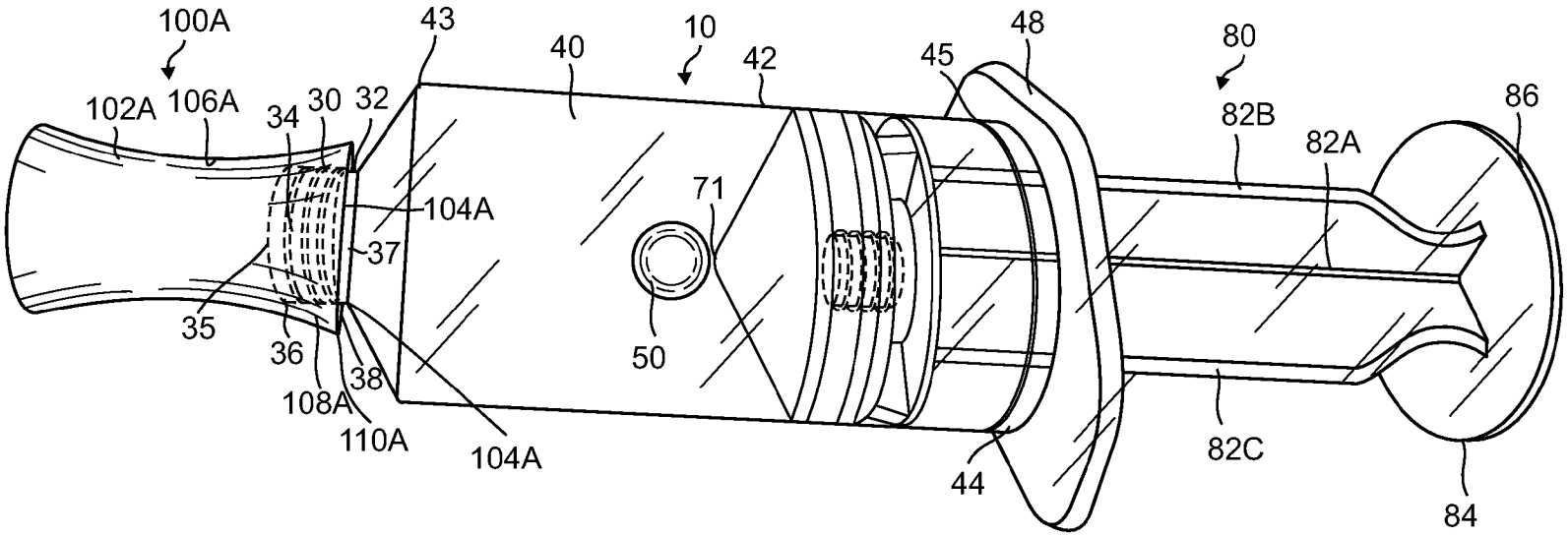
FIG. 2 is a side view of an assembled paint touch up tool similar to the embodiment illustrated in FIG. 1, with a different sealing cap without a built in applicator.

Referring to FIGS. 1 and 2, in FIG. 1 there is a perspective exploded view of an embodiment of the present invention paint touch up tool 10, including one embodiment of a sealing cap 100 as illustrated in FIG. 1, the sealing cap 100 having an exterior wall 102, an interior chamber 104 having an interior wall 106 with internal threads 108 adjacent a distal end 110, an internally retained shaft 112 extending out of the interior chamber 104 away from the distal end 110 with an applicator brush 114 at a distal end 116 of the internally retained shaft 112.

The paint touch up tool 10 further includes a retaining body 20 having an exterior wall 42 surrounding an interior chamber 24, the retaining body 20 having a nozzle 30 with exterior mating threads 32, the nozzle having an interior chamber 34 (See FIG. 2) with a proximal opening 35 at the proximal end 36 extending to a distal opening 37 at the distal end 38 of the nozzle 30. The distal opening 37 of the nozzle 30 leads to an interior chamber 40 of body 20, the interior chamber 40 surrounded by an exterior wall 42 terminating at a distal end 44 with a distal opening 46 at a base 48, a paint mixer such as a ball bearing 50, a plunger 80 having a protruding shaft or nozzle 54 with exterior threads 56 at its proximal end 58 and threaded onto internal threads 62 in the interior wall of base 61 of a sealing disc 60 incorporated into a plunger 70 with a plunger tip 71, a flexible seal 64 retained in a circumferential groove 66 of the sealing disc 60 and the handle 82 of the plunger 80 having a multiplicity of shafts 82A 82B, 82C, and a shaft (not shown) opposite shaft 82A, the plunger 80 terminating in a base 84 at its distal end 86.

FIG. 2 is a side view of an assembled paint touch up tool which is the same as FIG. 1 but illustrating an alternative sealing cap 100A without a built in applicator. The sealing cap 100A has an exterior wall 102A and an interior chamber 104A with an interior wall 106A with internal threads 108A adjacent a distal end 110A.

Figure 2A:
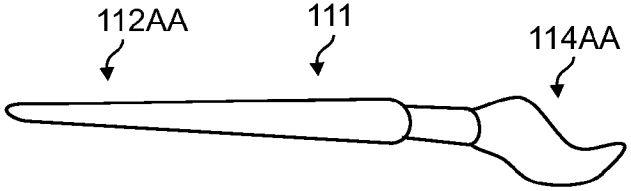
FIG. 2A is a side view of a paint brush.

When a cap without an applicator is used, it is necessary to have a separate applicator such as a paint brush 111, with shaft 112AA with a bristle tip 114AA as illustrated in FIG. 2A to apply the touch up paint 1000 when needed.

When a cap without an applicator is used, it is necessary to have a separate applicator such as a paint brush 111, with shaft 112 with a bristle tip 114 as illustrated in FIG. 2A to apply the touch up paint 1000 when needed.

Figure 3:
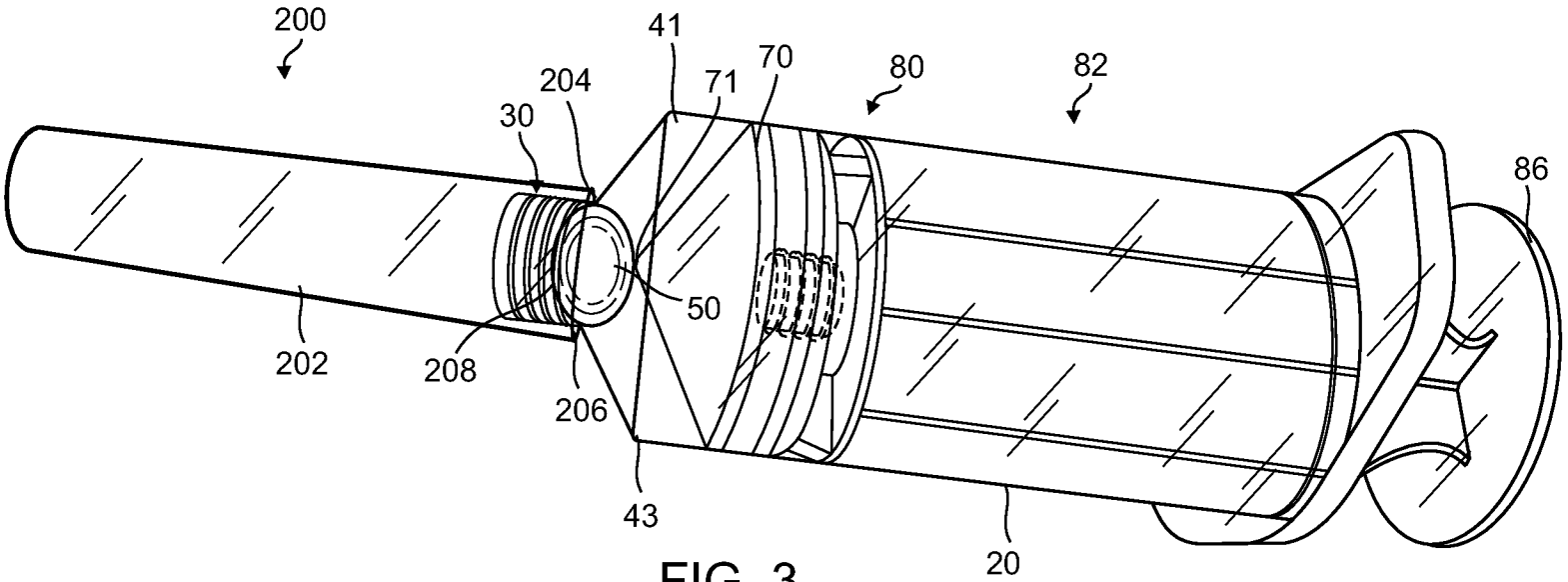
FIG. 3 is a side perspective view of an assembled paint touch up tool similar to the embodiment illustrated in FIG. 2, with the sealing cap removed and an extender or a fill tube affixed onto the nozzle of the body of the paint touch up tool, also illustrating the plunger pushed into the interior chamber of the body with the paint mixer trapped between the tip of the plunger and the interior opening of the nozzle.

FIG. 3 is a side perspective view of an assembled paint touch up tool 10 similar to the embodiment illustrated in FIG. 1 with the sealing cap 100 removed and an extender or a fill tube 200 affixed onto the nozzle 30 of the body 20 of the paint touch up tool 10. In this variation, the fill tube 200 is a rigid hollow cylinder with an exterior surface 202, an interior chamber 204 surrounded by an interior wall 206 having threads 208 which mate with the threads 32 on nozzle 30.

Also illustrated in FIG. 3 is a plunger 80 pushed into the interior chamber 40 of the body 20 to adjacent the proximal end 43 of the paint retaining body 20 with the paint mixer 50 trapped between the tip 71 of the plunger 80 and the interior opening 37 of the nozzle 30. The trapped paint mixer 50 creates an air gap 41 which enables the interior chamber 40 to be filled with paint without air bubbles forming within the chamber.

Figure 4:
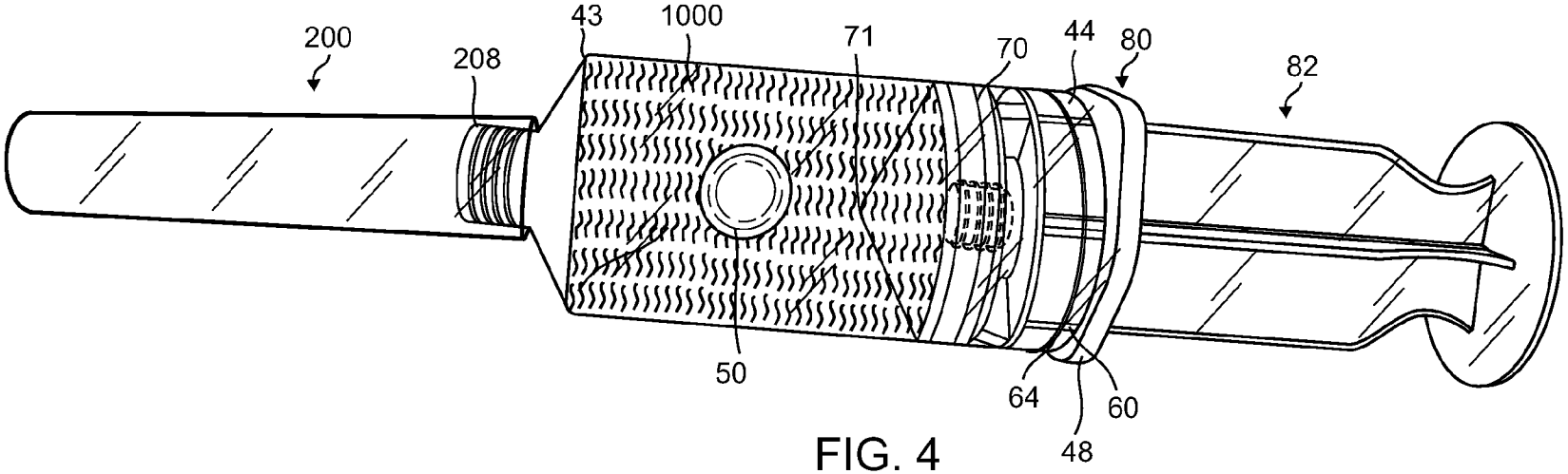
FIG. 4 is a side perspective view of an assembled paint touch up tool of an embodiment of a paint touch up tool illustrated in FIG. 3, with the sealing cap removed and an extender or a fill tube affixed onto the nozzle of the body of the applicator tube also illustrating the plunger retracted to adjacent the proximal end or base of the body of the paint touch up tool, the interior chamber of the body filled with paint.

FIG. 4 is a side perspective view of an assembled paint touch up tool 10 of an embodiment illustrated in FIG. 3, with the sealing cap 100 removed and an extender or a fill tube 200 affixed onto the nozzle 30 of the body 20 of the paint touch up tool 10, also illustrating the plunger 80 retracted to adjacent the distal end 44 and base 48 of the body 20 of the paint touch up tool 10. The fill tube 200 is inserted into the paint can or container which was used to paint the surface, and the suction of the plunger 80 moved from its tip 71 adjacent the proximal end 43 of interior chamber 40 to near the distal end 45 of the interior chamber 40 of body 20 causes the paint 1000 to be sucked into the interior chamber 40 of the body until the interior chamber 40 of the body 20 is filled with paint 1000 up to the proximal end 43 of the body 20. The air gap area 71 reduces bubbles within the interior chamber 40.

Figure 5:
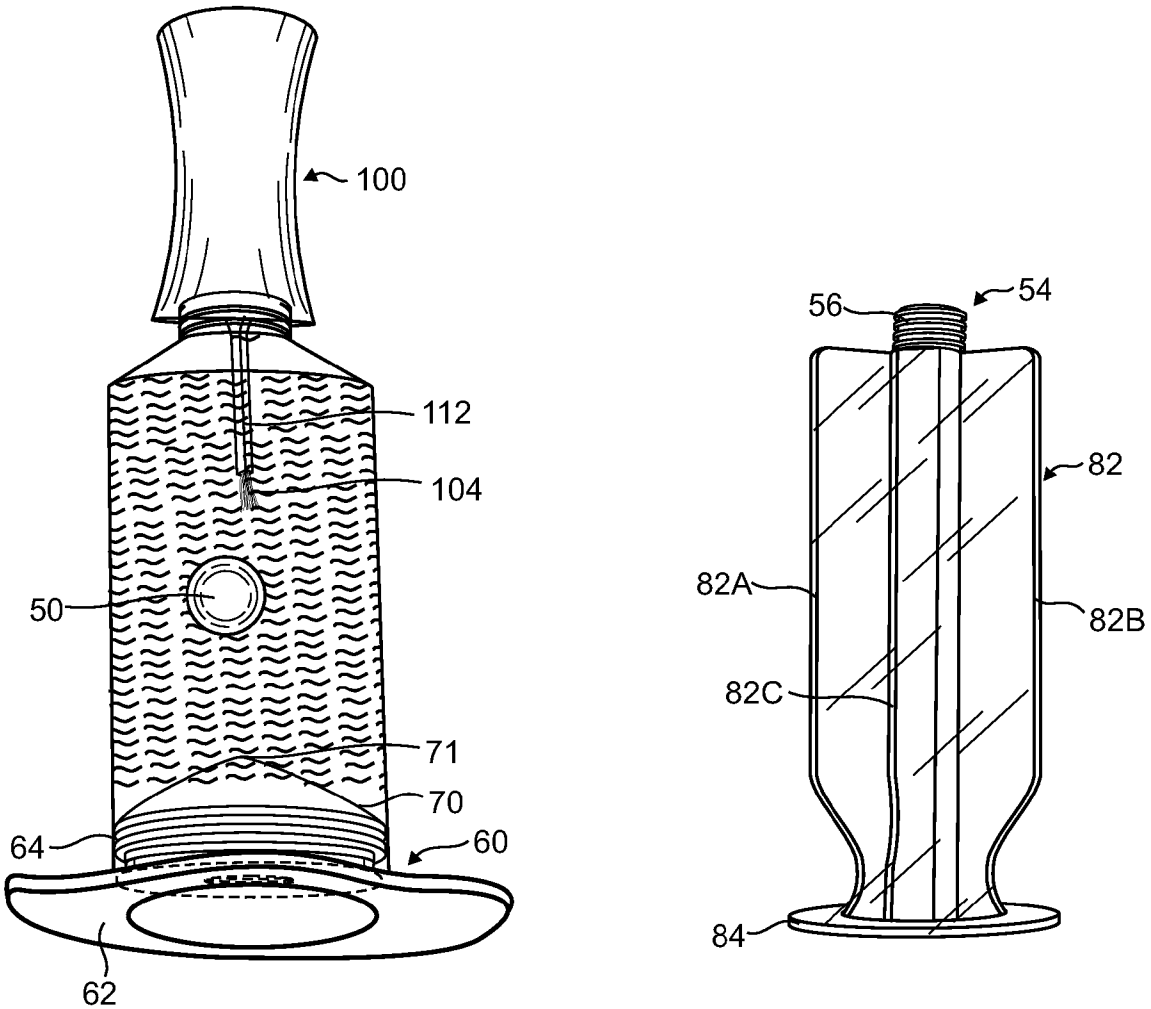
FIG. 5 is a two part vertical side view of the paint touch up tool of an embodiment illustrated in FIG. 1, with the sealing cap of FIG. 1 replaced onto the nozzle of the paint touch up tool body after the extender or a fill tube has been removed, the plunger un-threaded from the threads in the bottom wall of the sealing disc so that the touch up tool filled with paint is in condition to be stored until use of the paint is needed.

Referring to FIG. 5, the handle portion 82 of the plunger 80 is un-threaded from the bottom of disk 70, resulting in a two part paint touch up tool 10, with the sealing cap 100 of FIG. 1 replaced onto the nozzle 30 of the paint touch up tool body 20 after the extender or a fill tube 200 has been removed. The nozzle 54 of the plunger 80 un-threaded from the internal threads 62 of the sealing disc 60 enables the sealing disc 60 and plunger tip 71 to remain within the internal chamber 40 of the body 20 of the paint touch up tool 10 which is filled with paint 1000 and is in condition to be stored for later use when the paint 1000 is needed. The seal 64 enables the paint 1000 to remain in chamber 40 and not leak out of the chamber 40. The remainder of the plunger 80 with shafts 82A, 82B and 82C and handle 82 are discarded. It will be appreciated that the sealing cap 100A illustrated in FIG. 2 could be used in place of the cap 100 illustrated in FIGS. 1 and 5. If the sealing cap 100A is used, the paint brush 111 with the shaft 112AA retaining the brush 114AA is used to apply paint 1000 to a surface, when needed. If the cap 100A is used, a separate paint brush 111 with a shaft or body 112AA with brush 114AA is needed to apply the paint 1000. The paint mixer 50 is used to shake up the paint 1000 before the sealing cap 100 is removed. The body 20 is shaken to enable the mixer 50 to break up paint 1000 which has been stored for a long time.

Figure 6:
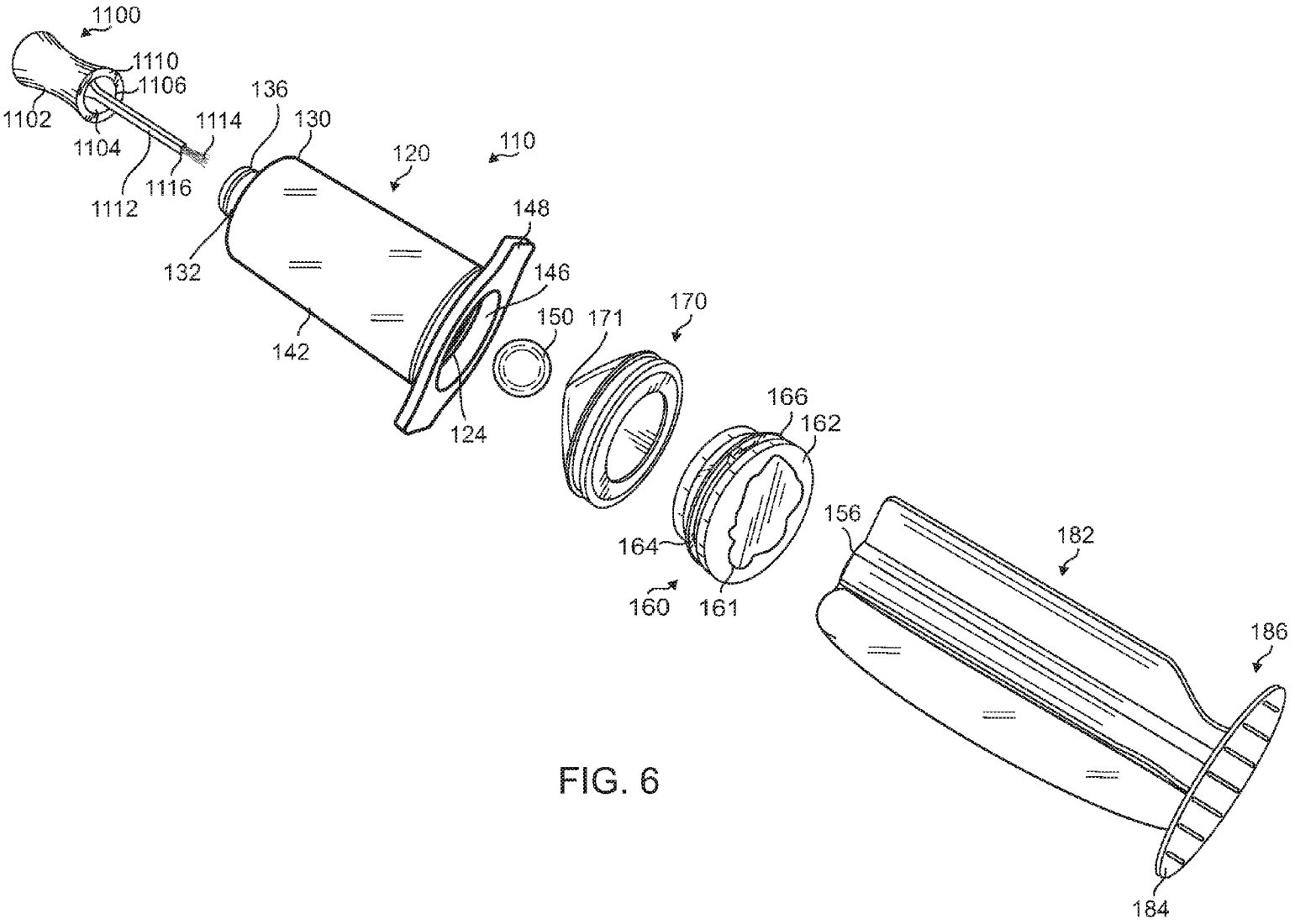
FIG. 6 is a perspective exploded view of another embodiment of the invention paint touch up tool, including one embodiment of a sealing cap having a smooth interior surface and an internal retained shaft with an applicator brush extending out of a distal end of the sealing cap, a retaining body having a threaded exterior nozzle at a proximal end leading to an interior chamber surrounded by an exterior wall terminating at a distal end with a base, a paint mixer such as a ball bearing, a plunger frangibly affixed at its proximal end threaded to a base of a sealing disc incorporated into a plunger tip, a flexible seal retained in a circumferential groove of the sealing disc and a handle of the plunger having a multiplicity of shafts terminating in a base at its distal end.
Figure 7:
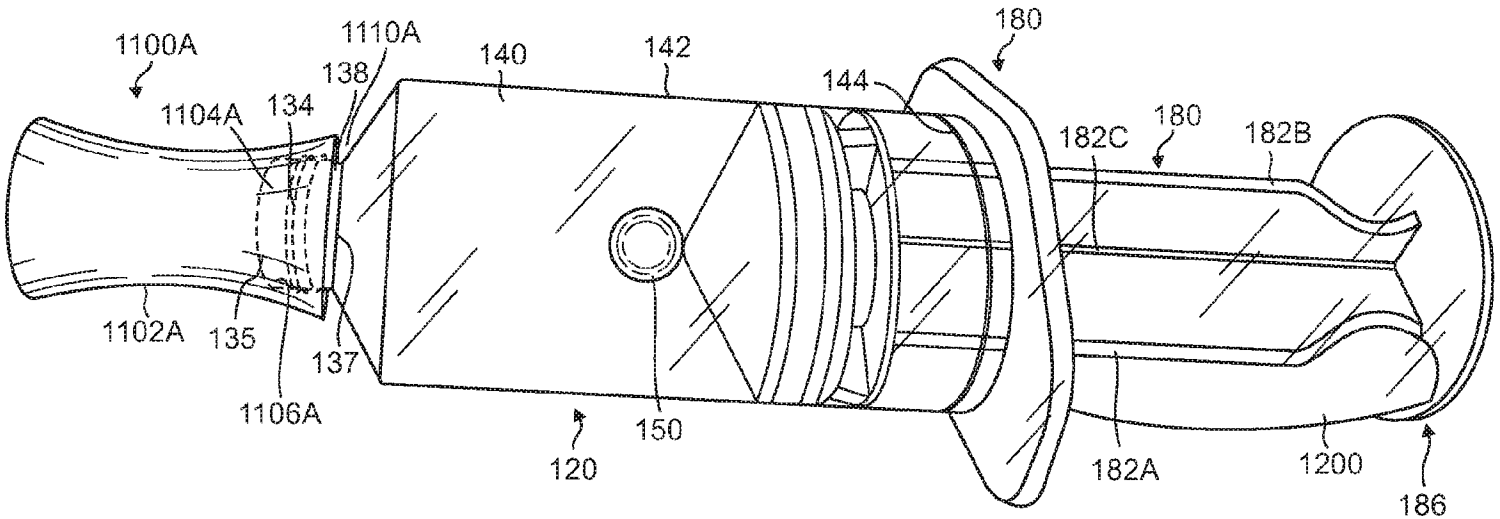
FIG. 7 is a side view of an assembled paint touch up tool similar to the embodiment illustrated in FIG. 6, with a different sealing cap without a built in applicator, with a flexible fill tube retained in the handle between the base wall of the sealing disc and the base of the plunger.

Referring to FIGS. 6 and 7, there is a perspective exploded view of an alternative embodiment of the present invention paint touch up tool 110, including one embodiment of a sealing cap 1100 as illustrated in FIG. 1, the sealing cap 1100 having an exterior wall 1102, an interior chamber 1104 having an interior wall 1106 with no internal threads, an internally retained shaft 1112 extending out of the interior chamber 1104 away from the proximal end 1110 with an applicator 1112 with a brush 1114 at a distal end 1116, extending away from the distal end 1110 of the sealing cap 1100. The smooth interior surface 1106 facilitates a press fit onto the nozzle 130 of the paint touch up tool body 120.

The paint touch up tool 110 further includes a retaining body 120 having an exterior wall 142 surrounding an interior chamber 146, the retaining body 120 having a nozzle 130 with a smooth surface 132 to facilitate a press fit retention of the sealing cap 1100. The nozzle 130 has an interior chamber 134 (See FIG. 7) with a proximal opening 135 at the proximal end 136 extending to a distal opening 137 at the distal end 138 of the nozzle 130. The distal opening 137 of the nozzle 130 leads to an interior chamber 140 of body 120, the interior chamber 140 surrounded by an exterior wall 142 terminating at a distal end 144 with a distal opening 146 at a base 148, a paint mixer such as a ball bearing 150, a plunger 180 including a handle 182 with a smooth surface at its proximal end 156 and affixed onto a bottom wall 162 of a sealing disk 160 incorporated into a plunger 170 with a plunger tip 171, a flexible seal 164 retained in a circumferential groove 166 of the sealing disc 160 and the handle portion 182 of the plunger 180 having a multiplicity of shafts 182A 182B, 182C, and a shaft (not shown) opposite shaft 182A, the plunger handle 182 terminating in a base 184 at its distal end 186. A score line 161 on the base 162 of sealing disk 169 enables the handle portion 182 of the plunger 180 to be broken off from the base 162 of the sealing disk 160.

FIG. 7 is a side view of an assembled paint touch up tool which is the same as FIG. 6 but illustrating an alternative sealing cap 1100A without a built in applicator. The sealing cap 1100A has an exterior wall 1102A, an interior chamber 1104A with an interior wall 1106A with no internal threads adjacent a distal end 1110A.

Figure 7A:
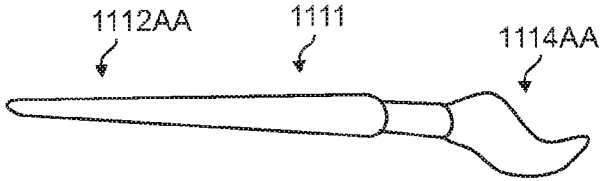
FIG. 7A is a side view of a paint brush.

When a cap without an applicator is used, it is necessary to have a separate applicator as illustrated in FIG. 7A, such as a paint brush 1111 with a shaft 1112AA with a bristle tip 1114AA as illustrated in FIG. 7A to apply the touch up paint 2000 when needed.

Figure 8:
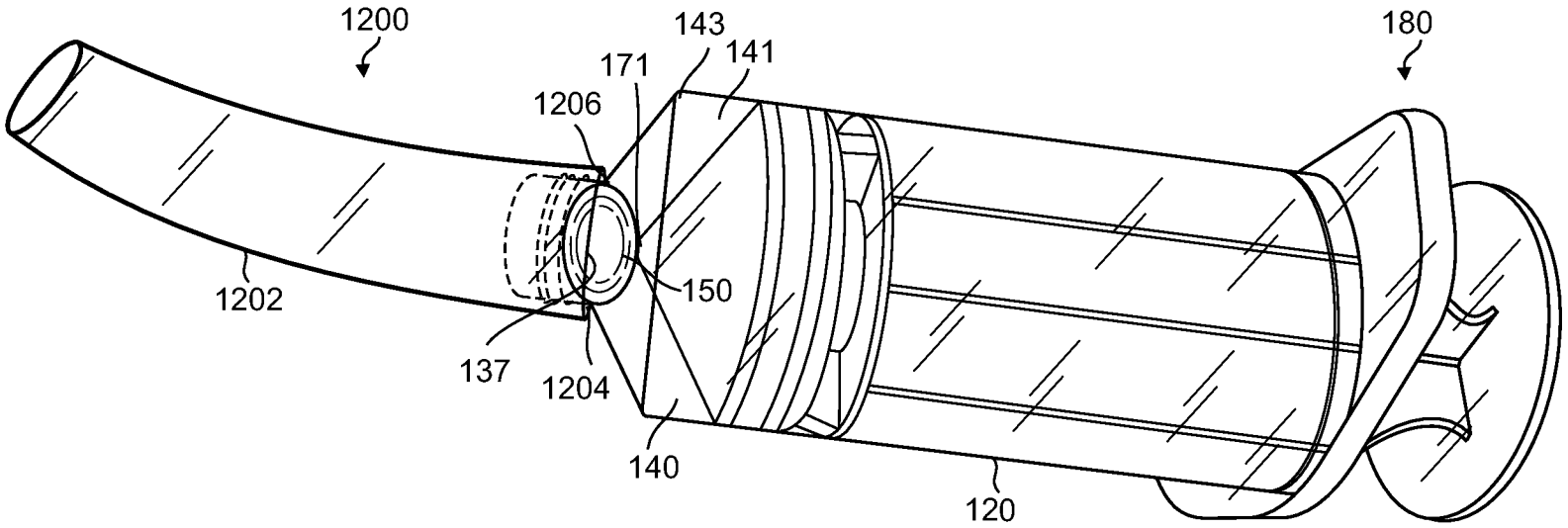
FIG. 8 is a side perspective view of an assembled paint touch up tool similar to the embodiment illustrated in FIG. 7, with the sealing cap removed and a flexible extender or a fill tube press fit affixed onto the nozzle of the body of the applicator tube, also illustrating the plunger pushed into the interior chamber of the body with the paint mixer trapped between the tip of the plunger and the interior opening of the nozzle.

FIG. 8 is a side perspective view of an assembled paint touch up tool 110 similar to the embodiment illustrated in FIG. 6 with the sealing cap 1100 removed and a flexible extender or a fill tube 1200 press fit affixed onto the nozzle 130 of the body 120 of the paint touch up tool 1100. In this variation, the fill tube 1200 is bent and flexible with a hollow interior with an exterior surface 1202, an interior chamber 1204 surrounded by a smooth interior wall 1206 having no threads which facilitates a press fit onto the nozzle 130. As illustrated in FIG. 7, when not in use, the flexible fill tube 1200 is press fit retained within the handle portion 182 of the plunger 180. When not in use the flexible fill tube 1200 is press fit retained within the plunger handle 182 between base wall 162 of sealing disc 160.

Also illustrated in FIG. 8 is a plunger 180 pushed into the interior chamber 140 adjacent the proximal end 143 of the body 120 with the paint mixer 150 trapped between the tip 171 of the plunger 180 and the interior opening 137 of the nozzle 130. The trapped paint mixer 150 creates an air gap 141 which enables the interior chamber 140 to be filled with paint without air bubbles forming within the chamber.

Figure 9:
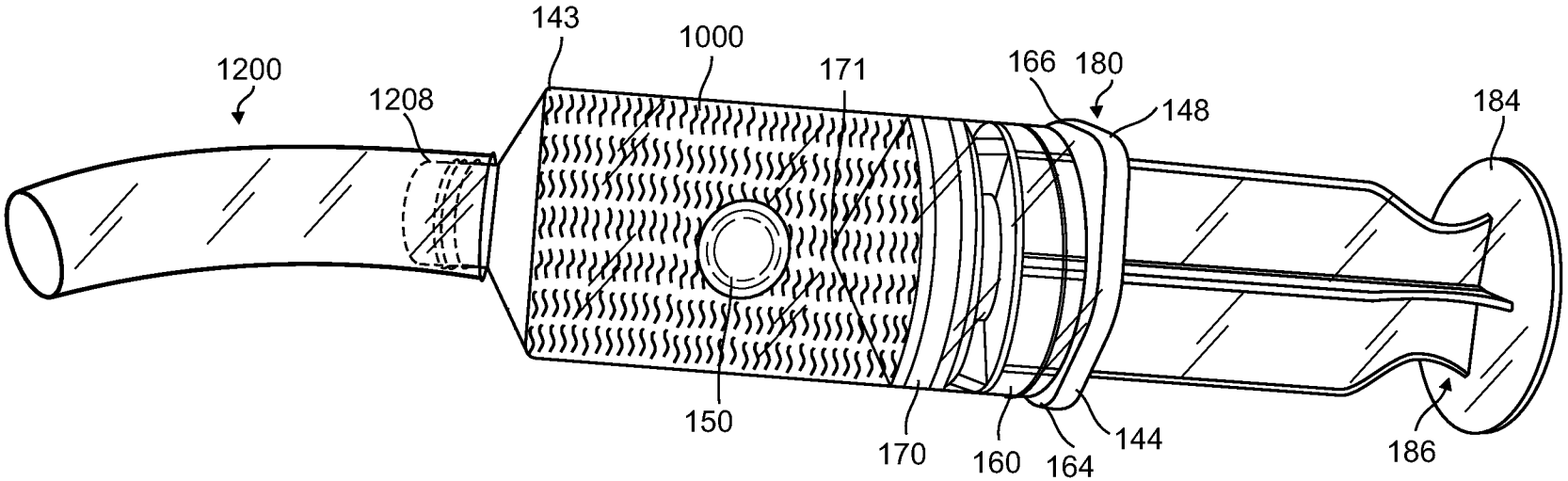
FIG. 9 is a side perspective view of an assembled paint touch up tool of an embodiment illustrated in FIG. 8, with the sealing cap removed and a flexible extender or a fill tube press fit affixed onto the nozzle of the body of the paint touch up tool, also illustrating the plunger retracted to adjacent the distal end or base of the body of the paint touch up tool, the interior chamber of the body filled with paint.

FIG. 9 is a side perspective view of an assembled paint touch up tool 110 of an embodiment illustrated in FIG. 8 with the sealing cap 1100 removed and an extender or a fill tube 1200 press fit affixed onto the nozzle 130 of the body 120 of the paint touch up tool 110 also illustrating the plunger 180 retracted to adjacent the distal end 144 and base 148 of the body 120 of the paint touch up tool 110. The fill tube 1200 is inserted into the paint can or container which was used to paint the surface, and the suction of the plunger 180 moved from its tip 171 adjacent the proximal end 143 of interior chamber 140 to near the distal end 144 of the interior chamber 140 of body 120 which causes the paint 1000 to be sucked into the interior chamber 140 of the body until the interior chamber 140 of the body 120 is filled with paint 1000 up to the proximal end 143 of the body 120. The air gap area 171 reduces bubbles within the interior chamber 140.

Figure 10:
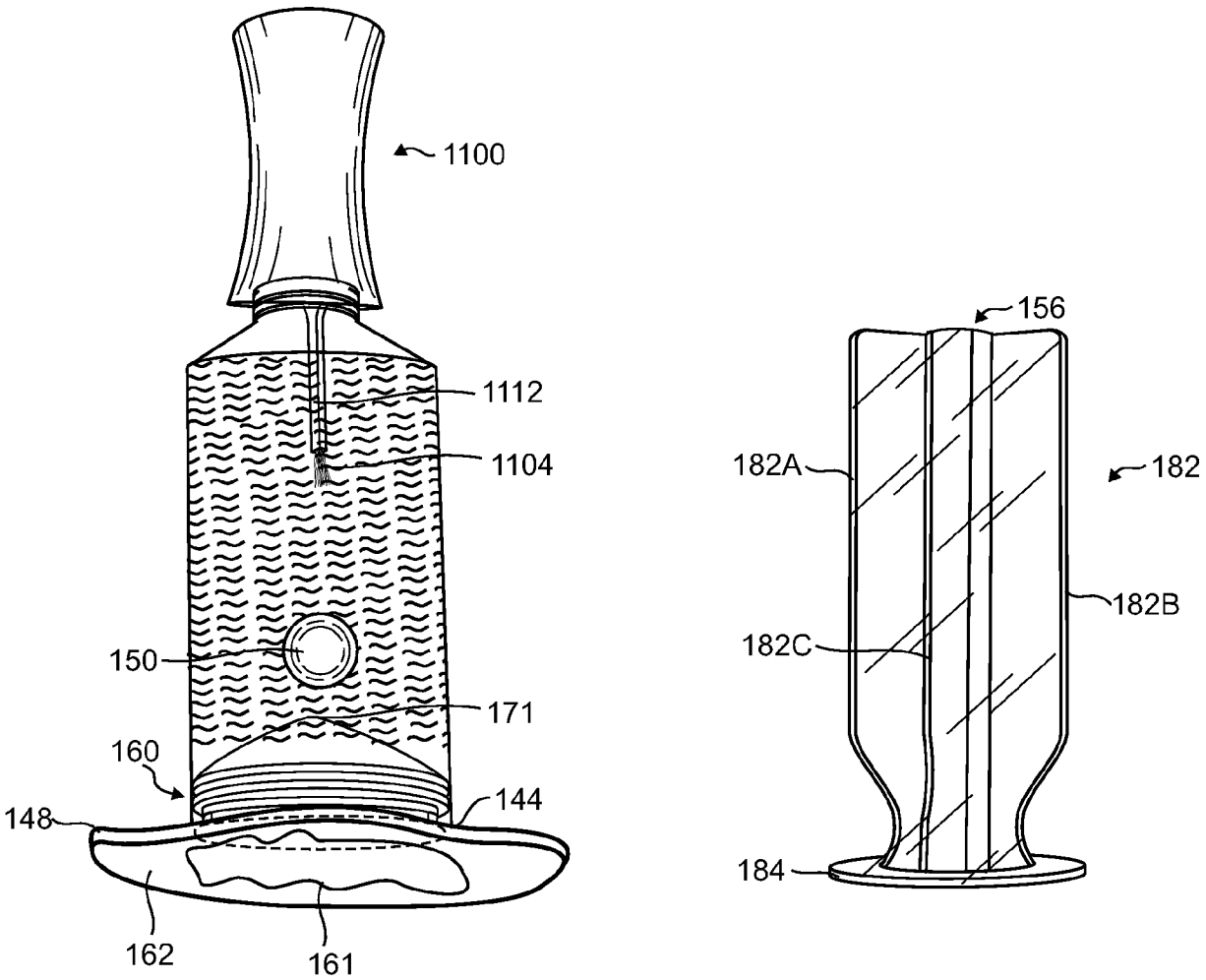
FIG. 10 is a two paint vertical side view of the paint touch up tool of an embodiment illustrated in FIG. 9, with the sealing cap of FIG. 7 replaced onto the nozzle of the paint touch up tool body after the extender or a fill tube has been removed, the handle of the plunger broken off at the score line on the base of the sealing disc so that the paint touch up tool filled with paint is in condition to be stored until use of the paint is needed.

Referring to FIG. 10, the handle portion 182 of the plunger 180 is broken off the bottom wall 162 of sealing disk 160 at the score line 161, resulting in a two-part paint touch up tool 110, with the sealing cap 1100 of FIG. 1 replaced onto the nozzle 130 of the paint touch up tool body 120 after the extender or a fill tube 1200 has been removed. The flexible seal 164 of the sealing disc 160 enables the paint 1000 to remain within the internal chamber 140 of the body 120 of the paint touch up tool 110 which is filled with paint 1000 and is in a condition to be stored for later use when the paint 1000 is needed. The seal 164 enables the paint 1000 to remain in and not leak out of the chamber 140. The remainder of the plunger handle 182 with shafts 180A, 180B, and 180C and handle 182 are discarded. It will be appreciated that the sealing cap 1100A illustrated in FIG. 7 could be used in place of the cap 1100 illustrated in FIG. 6. If the sealing cap 1100A is used, a separate paint brush 1111 with shade or paint brush handle 1112AA brush 1114AA is needed to apply the paint 1000. The paint mixer 150 is used to shake up the paint 1000 before the sealing cap 1100 is removed. The body 120 is shaken to enable the mixer 150 to break up paint 1000 which has been stored for a long time.

The present invention envisions that someone is painting a wall or other surface of any structure of either a residence or commercial structure, a vehicle or any other object (defined jointly as "a surface painted with at least one selected paint"). The individual selects the paint used to paint a surface painted with at least one selected paint and there usually is some paint left over. The object of the present invention is to store a quantity of the original paint to be used as touch up in the event there is a nick or scratch in the wall or if the wall has a hole or other blemish in it due to the fact that a painting or other decoration was hung on the wall and the apparatus used to retain the painting or structure was a nail or paint hanger which creates a hole in the wall, or to use touch up paint on any object when it was scratched or otherwise required use of touch up paint. For example, when the room is redecorated and the painting or other decoration is moved, there is left an unsightly hole from the hanging mechanism and therefore it is necessary to touch up that hole. The present invention provides a supply of the original paint so that the touch up will almost be unnoticeable.

Referring generally to the all of the figures, the present invention is a paint touch up tool comprising: (a) a syringe 10 which houses an enclosed interior chamber 40 which is surrounded by a circumferential wall 42; (b) a movable plunger 80 movably retained at a rear end 45 of the interior chamber 40, the movable plunger 80 having a first mating member 60 exterior wall, a sealing member 64 adjacent a proximal end of the plunger 80 located at the rear end 45 of the interior chamber 40 and retained adjacent the rear 45 of the interior chamber 40 after a handle 82 of the plunger 80 is removed, the handle 82 of the movable plunger 80 also having a multiplicity of shafts 82A, 82B and 82C between a lower surface 62 of the sealing member 60 and a base 84 of the plunger handle 82; (c) a front end 43 of the interior chamber 40 leading to a nozzle 30 which is closed by a closing cap 100; (d) a paint mixer 50 retained in the enclosed interior chamber 40; (e) an extender 200 when not in use is retained separately from the plunger 80 or alternatively may be retained between a lower surface 62 of the sealing member 60 and a base 84 of the plunger handle 82; (f) when the closing cap 100 is removed from the nozzle 30, the extender or fill tube 50 is placed over the nozzle and the plunger i80 s used to suck paint out of a paint retaining member such as a paint can and into the interior chamber 40 body of the syringe; (g) the extender is removed, the closing cap is replaced onto the nozzle 30 to seal the syringe 10 with the paint 1000 therein and the rear handle 82 of the plunger 80 is removed to enable the paint filled syringe to be stored until needed.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A paint touch up tool, comprising:

a. a sealing cap having an exterior wall, and a sealing cap interior chamber having an interior wall with an interior surface and a distal end;

b. a retaining body having an exterior wall surrounding a retaining body interior chamber, the retaining body having a nozzle with an exterior surface to retain the interior surface of the sealing cap, the nozzle having a nozzle interior chamber with a proximal opening at a proximal end of the nozzle extending to a distal opening at a distal end of the nozzle leading to the interior chamber of a body, the interior chamber of the body surrounded by the exterior wall and terminating at a distal end with a distal opening at a base, a paint mixer retained in the interior chamber of the body, a plunger with a sealing disc incorporated into a plunger tip at the distal opening of the internal chamber of the body and a flexible seal retained in a circumferential groove of the sealing disc, a plunger handle removably affixed onto a base of the sealing disc at a distal end of the interior chamber, the plunger handle terminating in a base at its distal end, the plunger handle having a smooth surface at its proximal end and frangibly affixed onto a lower wall of the base of sealing disc; and c. a fill tube retained onto the nozzle of the body when the sealing cap is removed.

2. The paint touch up tool in accordance with claim 1, further comprising: a score line at a location where the smooth proximal surface of the plunger handle is frangibly affixed to a lower wall of the base of the sealing disc.

3. The paint touch up tool in accordance with claim 1, further comprising: the interior surface of the sealing cap is smooth and the retaining body having a nozzle having a smooth exterior surface, the smooth interior surface of the sealing cap is press fit retained onto the smooth exterior surface of the nozzle.

4. The paint touch up tool in accordance with claim 3, further comprising: the sealing cap including an internally retained shaft extending out of the interior chamber of the sealing cap away from the distal end of the sealing cap with an applicator brush at a distal end of the internally retained shaft.

5. The paint touch up tool in accordance with claim 1, further comprising: the interior surface of the sealing cap having internal threads adjacent its distal end and the retaining body having a nozzle with exterior mating threads which mate having the internal threads of the sealing cap.

6. The paint touch up tool in accordance with claim 5, further comprising: the sealing cap including an internally retained shaft extending out of the interior chamber away from the distal end with an applicator brush at a distal end of the internally retained shaft.

7. The paint touch up tool in accordance with claim 1, further comprising: the fill tube is a rigid hollow cylinder having threads on an interior surface adjacent a distal end and the nozzle of the retaining body having exterior threads which mate with the threads on the interior surface of the fill tube.

8. The paint touch up tool in accordance with claim 1, further comprising: the fill tube is a hollow flexible member having a smooth interior surface and the nozzle of the retaining body having a smooth surface to press fit retain the smooth interior surface of the fill tube.

9. The paint touch up tool in accordance with claim 8, further comprising: the handle of the plunger having a multiplicity of shafts terminating at the base of the distal end of the handle, and the fill tube is retained on the plunger handle between a pair of shafts and between a lower wall of the sealing disc and the base of the handle of the plunger.

10. The paint touch up tool in accordance with claim 1, further comprising: the handle of the plunger having a multiplicity of shafts terminating at the base of the distal end of the handle.

11. The paint touch up tool in accordance with claim 1, further comprising: the paint mixer is trapped between the distal opening at the distal end of the retaining body nozzle and a proximal tip of the plunger when the plunger is pushed into the interior chamber and the plunger tip is at a location adjacent a proximal end of the interior chamber.

12. The paint touch up tool in accordance with claim 11, further comprising:

a. the fill tube is retained on the retaining body nozzle after the sealing cap is removed; and b. the fill tube is adapted to be inserted into paint retained in a container and the plunger is retracted to adjacent the distal end of the interior chamber of the body causing paint to be sucked into the interior chamber of the body until the interior chamber of the body is filled with paint up to the proximal end of the body.

13. The paint touch up tool in accordance with claim 12, further comprising: the handle of the plunger is removed and paint is stored in the interior chamber for subsequent use.

14. A paint touch up tool, comprising:

a. a sealing cap having an exterior wall, and a sealing cap interior chamber having an interior wall with an interior surface and a distal end;

b. a retaining body having an exterior wall surrounding a retaining body interior chamber, the retaining body having a nozzle with an exterior surface to retain the interior surface of the sealing cap, the nozzle having a nozzle interior chamber with a proximal opening at a proximal end of the nozzle extending to a distal opening at a distal end of the nozzle leading to the interior chamber of a body, the interior chamber of the body surrounded by the exterior wall and terminating at a distal end with a distal opening at a base, a paint mixer retained in the interior chamber of the body, a plunger with a sealing disc incorporated into a plunger tip at the distal opening of the internal chamber and a flexible seal retained in a circumferential groove of the sealing disc, the interior surface of the sealing cap having internal threads adjacent its distal end and the retaining body having a nozzle with exterior mating threads which mate with the internal threads of the sealing cap, the sealing cap including an internally contained shaft extending out of the interior chamber away from the distal end with an applicator brush at a distal end of the internally retained shaft and c. a fill tube retained onto the nozzle of the body when the sealing cap is removed.

15. A paint touch up tool, comprising:

a. a sealing cap having an exterior wall, and a sealing cap interior chamber having an interior wall with an interior surface and a distal end; and b. a retaining body having an exterior wall surrounding a retaining body interior chamber, the retaining body having a nozzle with an exterior surface to retain the interior surface of the sealing cap, the nozzle having a nozzle interior chamber with a proximal opening at a proximal end of the nozzle extending to a distal opening at a distal end of the nozzle leading to the interior chamber of the body, the interior chamber of the body surrounded by the exterior wall and terminating at a distal end with a distal opening at a base, a paint mixer retained in the interior chamber of the body, a plunger with a sealing disc incorporated into a plunger tip at the distal opening of the internal chamber and a flexible seal retained in a circumferential groove of the sealing disc, and a fill tube retained onto the nozzle of the body when the sealing cap is removed, the fill tube is a hollow flexible member having a smooth interior surface and a nozzle of the retaining body having a smooth surface to press fit retain the smooth interior surface of the fill tube, the handle of the plunger having a multiplicity of shafts terminating at the base of the distal end of the handle and the fill tube is retained on the plunger handle between a pair of shafts and between a lower wall of the sealing disc and the base of the handle of the plunger.

* * * * *